US005275685A

United States Patent [19]

Stauber

[11] Patent Number: 5,275,685

[45] Date of Patent: Jan. 4, 1994

[54] APPARATUS FOR GLUING ATTACHMENT SLIPS TO PRINTED PRODUCTS

[75] Inventor: Hans-Ulrich Stauber, Grüt, Switzerland

[73] Assignee: Ferag AG, Hinwil, Switzerland

[21] Appl. No.: 28,760

[22] Filed: Mar. 9, 1993

Related U.S. Application Data

[63] Continuation of Ser. No. 960,589, Oct. 13, 1992.

[30] Foreign Application Priority Data

Nov. 7, 1991 [CH] Switzerland ..... 03250/91

[51] Int. Cl.[5] ..... B65C 7/00

[52] U.S. Cl. ..... 156/556; 156/566; 156/567; 156/568

[58] Field of Search ..... 156/556, 566, 567, 568, 156/521

[56] References Cited

U.S. PATENT DOCUMENTS

| | | | |
|---|---|---|---|
| 3,450,400 | 6/1969 | Guggisberg | 270/55 |
| 3,751,324 | 8/1973 | Enskat | 156/567 X |
| 3,826,706 | 7/1974 | Muller | 156/571 |
| 3,871,943 | 3/1975 | Zodrow | 156/521 |
| 3,877,692 | 4/1975 | Kluge et al. | 270/55 |
| 4,533,132 | 8/1985 | Wangermann | 270/53 |
| 4,981,291 | 1/1991 | Hunegger et al. | 270/55 |
| 5,022,954 | 6/1991 | Plaessmann | 156/567 X |
| 5,052,666 | 10/1991 | Hänsch | 270/55 |
| 5,052,667 | 10/1991 | H nsch . | |
| 5,094,438 | 3/1992 | Reist et al. | 270/55 |
| 5,104,108 | 4/1992 | Honegger | 270/55 |
| 5,116,452 | 5/1992 | Eder | 156/567 X |
| 5,137,596 | 8/1992 | Potter | 156/566 X |

FOREIGN PATENT DOCUMENTS

| | | |
|---|---|---|
| 2049850 | 4/1972 | Fed. Rep. of Germany . |
| 2160772 | 6/1973 | Fed. Rep. of Germany . |
| 2135303 | 8/1973 | Fed. Rep. of Germany . |

*Primary Examiner*—David A. Simmons
*Assistant Examiner*—James J. Engel, Jr.

[57] ABSTRACT

The gluing apparatus has several carrier arms attached to a rotating organ, which carry holders at their free ends. Each holder picks up an attachment slip at the supply point, transports it past an adhesive-applicator apparatus whereby adhesive is applied to the attachment slips, and on to the printed products to which the slips are then attached. The printed products are transported on supports placed perpendicular to the feed direction (A), the holders enter between consecutive pairs of supports and have means of control to move them against supports, in order to glue the attachment slips on the printed products and press them firmly into place.

15 Claims, 4 Drawing Sheets

APPARATUS FOR GLUING ATTACHMENT SLIPS TO PRINTED PRODUCTS

This is a continuation of co-pending application Ser. No. 07/960,589 filed on Oct. 13, 1992.

BACKGROUND OF THE INVENTION

The present invention relates to an apparatus for gluing attachment slips to printed products, such as printed periodicals.

PRIOR ART

An apparatus of this kind is known from CH-A 538 366. In this the printed sheets are guided by a chain conveyor of triangular cross-section in a straight line past a gluing apparatus, to glue attachment slips to printed sheets. The chain-conveyor system has supporting elements placed behind one another parallel to the feed direction and form the sides of conveyor system, with which the printed sheets are in contact. The gluing apparatus has a grip-and-deposit drum on one side of the feed system and is driven to rotate about an axis transverse to the chain conveyor's feed direction and parallel to the supporting elements, and is in tangential contact with the printed sheets. With each rotation of the grip-and-deposit drum, its mechanically controlled gripper system pulls an attachment slip from a stack. As the drum continues to rotate, an adhesive-applicator system applies a line of adhesive to the attachment slip held on the drum. When the slip reaches the printed sheet, the grip-and-deposit drum presses it on to the sheet. The side panels form a counter-support for the printed sheets.

DE-A 26 31 058 discloses another apparatus for gluing attachment slips to printed products. This has a driven rotary accelerating drum with separately controlled grippers which pulls printed and folded sheets from a stack one at a time, holds them against the drum, and turns them through 180°. Near the end of the deflection motion, centrifugal force opens the folded sheets and a conveyor having rods perpendicular to the feed direction picks up the open sheets and continues their transport. The gluing apparatus has a gluing roller driven parallel to and at the same speed but in the opposite sense to the accelerating drum, pulls an attachment slip from a storage stack, and applies it to the printed sheet held against the drum. An adhesive-applicator apparatus between the stack of attachment slips and the accelerating drum sprays adhesive on to each attachment slip.

SUMMARY OF THE INVENTION

Based upon this prior art, one object of the present invention is to propose a generic apparatus that makes it possible to glue attachment slips to printed products at high machine speeds by means of differently constructed conveyor systems.

The present invention meets these requirements by having rotary means with supporting elements transporting the printed documents in a feed direction and a gluing apparatus which transports attachment slips from a supply point past an adhesive applicator to the printed products in the rotary means. The gluing apparatus includes means for pressing the attachment slips onto the printed products by means of holders and means for controlling holder movements toward the respective supporting elements for pressing the slips against printed products supported on the supporting elements.

The invention described in this disclosure makes it possible to attach attachment slips reliably and correctly positioned to printed products moving at high speed and lying against supports placed behind one another and perpendicular to the conveyor's feed direction.

Preferred embodiments of the invention proposed by the present disclosure are described in the relevant claims.

A typical embodiment of the present disclosure is described in greater detail by reference to the drawings attached hereto which illustrate this invention in purely diagrammatic form, as follows:

Figure 1:
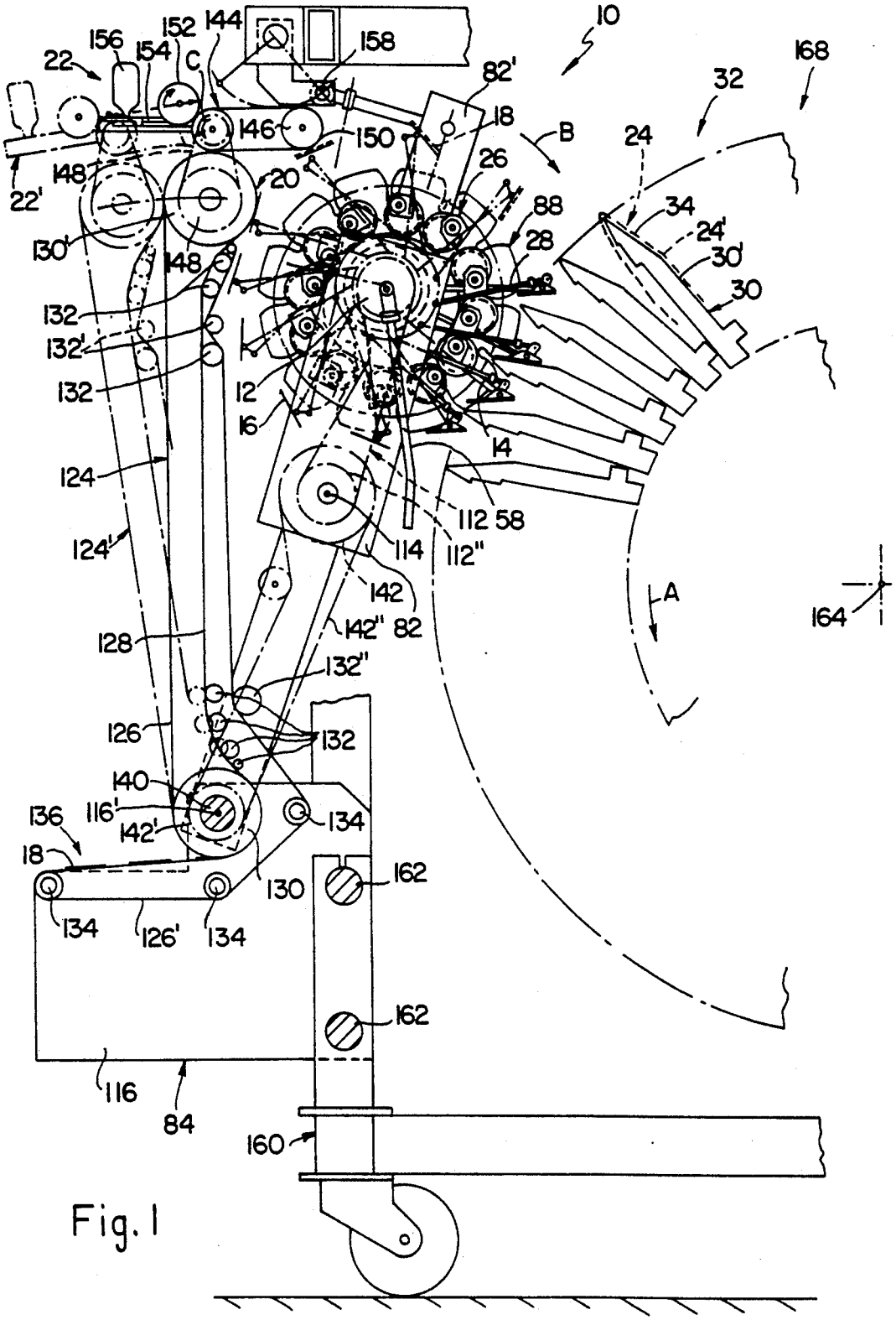
FIG. 1 is a simplified view of an embodiment of the apparatus referred to in the present disclosure.

The folded printed products 24 are transported in the feed direction A astride saddle-shaped supporting elements 30 of a conveyor system 32 past a gluing apparatus 10. The supporting elements 30, which are set at fixed intervals behind one another, extend lengthwise more or less at right angles to the feed direction A, and the rear wall element 30' of the supporting elements 30, as viewed in the feed direction A, forms a support 34, in close contact with which, within range of the gluing apparatus 10, lies the rear part 24' of the printed product 24.

The rotating organ 12 with its carrier arms 14 and holders 16 is driven to rotate in direction B, so that each carrier arm 14 and its holder 16 fits between two consecutive supporting elements 30 of the conveyor system 32 to glue the slip 18 to the portion 24' of the printed product 24 that lies against the support 34.

Figure 2:
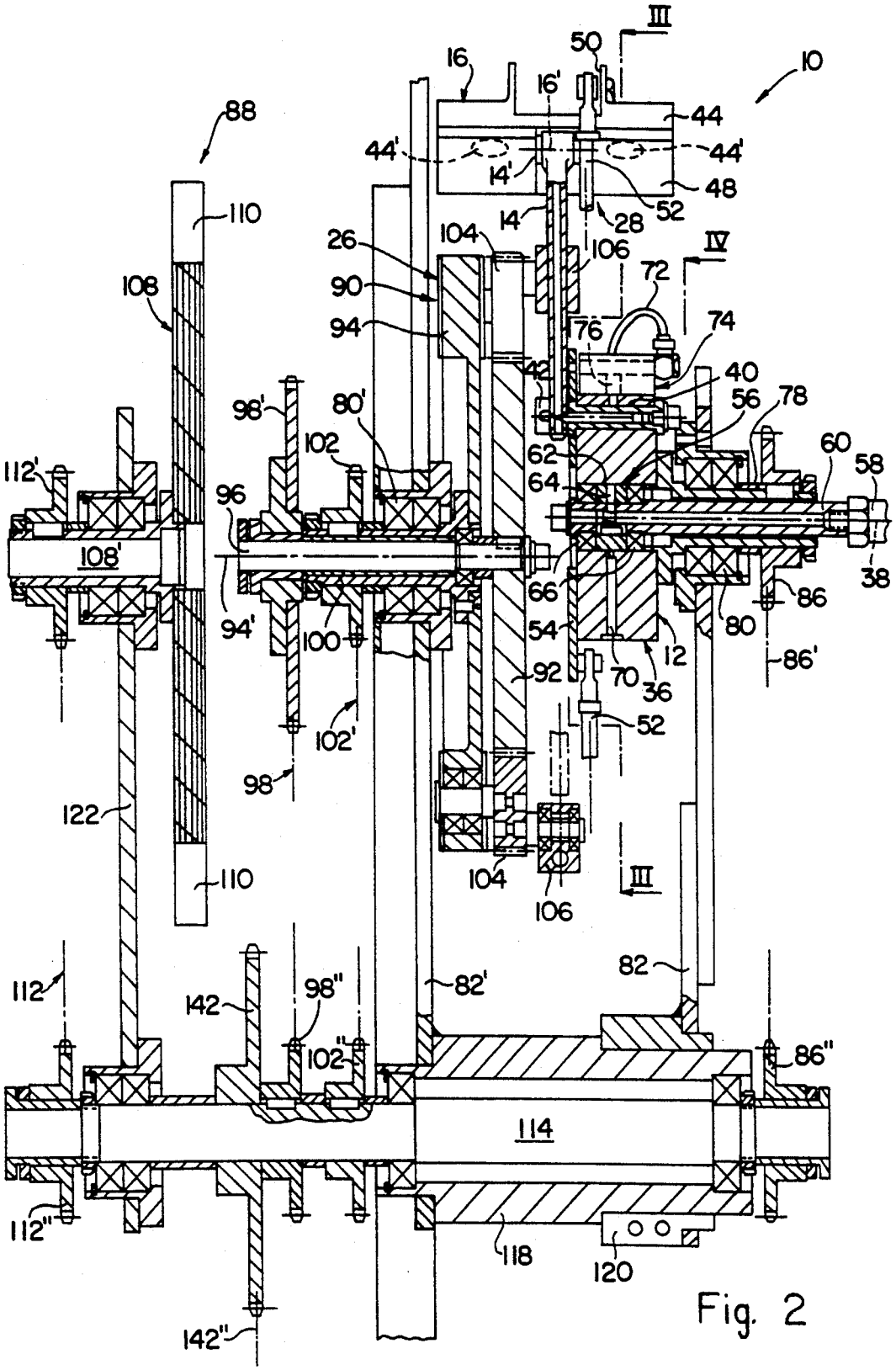
FIG. 2 is a section and partial side elevation view of the gluing apparatus, enlarged from FIG. 1.
Figure 3:
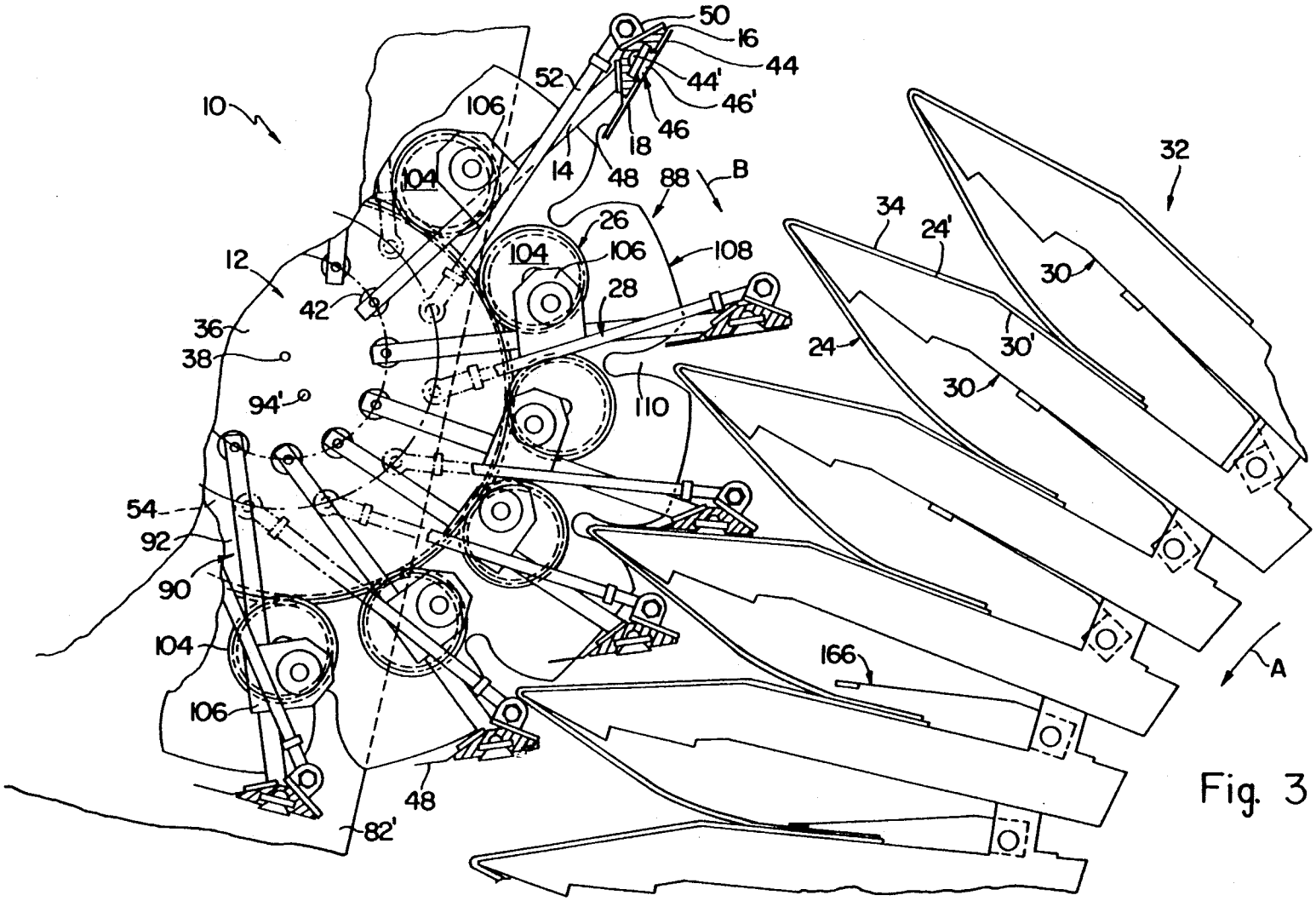
FIG. 3 is a view along line III—III in FIG. 2 and shows parts of the conveyor system.

In conjunction with the following detailed description of the construction of the gluing system 10, refer to the drawings, particularly FIGS. 2 and 3.

The rotating organ 12 has a bearing box 36 which is driven to rotate about shaft 38 in direction B. Placed in a circle about shaft 38, hollow shafts 40 pass through the bearing box 36, each having a head 42 on the side that faces the means of control 26; a tubular-shaped carrier arm 14 is attached to each head 42. Lengthwise, each carrier arm 14 is perpendicular to the hollow shaft 40 which is secured to bearing box 36 and can rotate freely about an axis parallel to the shaft 38. Each hollow shaft 40 is closed on the side opposite head 32.

A holder 16 is secured to each carrier arm 14 and can rotate freely about pivot 16' which is likewise parallel to shaft 38. Each holder 16 has a holding element 44 in which the axle 14' is engaged, the axle being shaped as a hollow shaft projecting from the carrier arm 14 in the direction of the swing axis 16' about which the holding element 44 can pivot. On the side facing away from this axle, the holding elements 44 have a flat surface and two recesses 44' separated from each other, but connected by a channel in the holding elements 44 to permit the free flow of air to each other and to the axle journals 14', and from these to the tubular carrier arms 14. Suction heads 46 with continuous lips 46' of elastic material, such as rubber, are fitted in the recesses 44' and project beyond the holding elements 44 (cf FIG. 3). Further, a supporting element 48, for example of thin metal plate, is fitted to the holding element 44 flush with its flat surface, in order that together with the holding element 44 it can provide support to the whole of the surface of the attachment slip 18 and prevent it from being bent or damaged. The suction heads 46 projecting from the holder 16 hold an attachment slip 18 by partial vacuum during its transport from the supply point 20 to the printed product 24 which is in close contact with the support 34. To press the slip 18 upon the printed product 24, the means of control 26 moves the holder 16 to the support 34 and presses the whole surface of the holder 16 against the printed product 24 on its support 34, whereby it causes elastic deformation of the lips 46' and presses the attachment slip 18 firmly upon the printed product 24.

A control lever 50 projects on the face opposite the flat surface of the holding element 44, with which a control rod 52 forms a jointed connection. The control rod 52 crosses the carrier arm 14 and at its other end beyond the bearing box 36, again by a joint, connects to a ring-shaped disk 54 attached to the bearing box 36. The control rod 52 acts as a further means of control 28 and determines the pivot angle of the holder 16 in accordance with the pivot angle of the carrier arm 14. Alternatively, the control rods can be connected directly to the bearing box 36.

Figure 4:
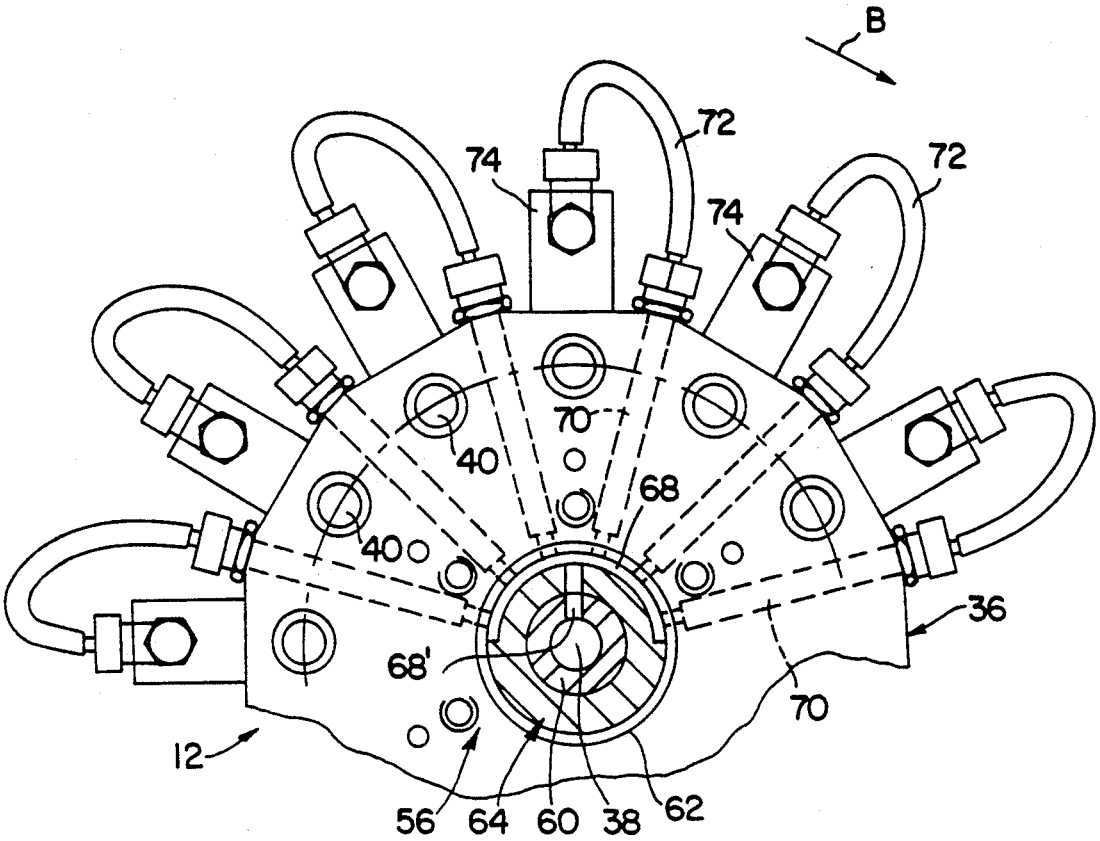
FIG. 4 is a view along line IV—IV in FIG. 2 and shows part of the gluing apparatus, The gluing apparatus 10 shown in FIGS. 1 to 3 inclusive has a rotating organ 12 that in turn has several carrier arms 14; in the present case twelve in all. At its free end, each carrier arm 14 carries a holder 16 designed to receive a slip for attachment 18, for example a card, at a supply point 20 (FIG. 1), move the slip 18 past an adhesive-applicator apparatus 22, then transport it to a printed product 24, for example a periodical or part thereof, and press it on to said product. For this purpose, means of control 26 are provided to govern the pivot angle of the carrier arms 14 that cantilever out from the rotating organ 12. Further means of control 28 ensure that the holders 16 are in the required cantilevered position in relation to the carrier arms 14.

A valve system 56 ensures that the suction heads 46 are under partial vacuum only within the area from the supply point 20 to the relevant support 34. A hollow shaft 60 connected by a hose to a compressed-air supply (not shown) passes at intervals through the bearing box 36 concentrically with shaft 38. For this purpose, the bearing box 36 has a central hole 62 in which a valve unit 64 is placed, each having a ballbearing 66 on each side (FIG. 2 and 4). The ballbearings 66 are supported on the hollow shaft 60 and the bearing box 36. The valve unit 64 wedged into place on the hollow shaft 60 has on its circumference a valve groove 68 that extends through about 180° and is connected to the compressed-air source by a radial channel 68' via the valve unit 64 and the hollow shaft 60. Between each pair of hollow shafts 40, a channel 70 passes radially through the bearing box 36 and connects by a hose 72 to an ejector valve 74. The ejector valves 74 are attached to the circumference of the bearing box 36 and provide the partial vacuum for the suction heads 46. For this purpose each ejector valve 74 is connected for free air flow by a vacuum channel 76 to its hollow shaft 40. Because the bearing box 36 rotates with its ejector valves 74 about the stationary hollow shaft 60, the ejector valves 74 are always supplied with compressed air. Hence the suction heads 46 are under partial vacuum whenever a channel 70 happens to be opposite the valve groove 68.

The face of the bearing box 36 is flanged to a hollow bearing shaft 78 which can rotate freely in a set of bearings 80 fitted to a bearing plate 82, on whose other end a sprocket wheel 86 is wedged into place. This sprocket wheel 86 is mechanically linked by a chain 86', shown by a dot-dashed line, to a drive system 88 described below.

The means of control 26 for the pivot angle of the carrier arms 14 have a planetary transmission 90 placed eccentrically and axially offset in relation to shaft 38 on a second bearing plate 82' supported by a frame. The central sunwheel 92 and spider 94 of the planetary transmission 90 rotate about shaft 94'. The central wheel 92 is wedged into place on a central shaft 96 and is likewise connected to the drive system 88 by a second chain drive 98. The sprocket wheel 98' of chain drive 98 is fixed to the central shaft 96 so that it cannot turn independently of it. The central shaft 96 passes through a webbed hollow shaft 100 on bearings that allow free rotation. At its end facing the central shaft 92, the shaft 100 has a wheel-shaped spider 94 flanged to it. At the end of the spider shaft 100 facing the sprocket wheel 98', a sprocket wheel 102 of a further chain drive 102' is wedged into place on the spider shaft 100, to link spider 94 likewise to the drive system 88. A second bearing plate 82' supports the spider shaft 100 on a second set of bearings 80' that allow the shaft 100 to rotate freely. The planetary wheels 104 are held in bearings on spider 94, one for each carrier arm 14. On each planetary wheel 104, a guide element 106, through which the carrier arm passes, is fitted eccentrically and can rotate freely. The carrier arms 14 are thus held so that they can slide lengthwise in the guide elements 106.

The spider 94 and the bearing box 36 are driven at the same speed of rotation in direction B, but the central wheel 92 is geared down by the chain drive 98 and thus turns in the same sense but only at half the speed. The ratio of the central wheel's diameter 92 to that of the planetary wheels 104 is such as to ensure that the planetary wheels 104 make three complete turns when spider 94 makes a single complete turn.

This design of the means of control 26 and of the further means of control 28 produces the movement sequence of the holders 16 as shown in FIG. 1. Within the area of the supply point 20, the holders 16 are so oriented as to place their flat surface approximately tangential to their orbital track and to face outward in relation to this track. They maintain their position as they pass the adhesive-applicator apparatus 22 placed after the supply point 20. As the holders 16 continue to rotate in the direction indicated by arrow B, they pivot and move their flat surface to an approximately radial position facing forward. The area in which the attachment slips 18 are pressed on to the printed products 24 and glued thereto is more or less diametrically opposite the supply point 20 in relation to the rotating shaft 38 of the bearing box 36. In this area, because of the forward-pivoting movement of the carrier arms 14, the means of control 26 accelerate the holders 16, so that they move over to and press against the supports 34. The holders 16 are then delayed to release them from the support 34 with the attachment slip 18 glued to the printed product 24, and to move them in a direction approximately perpendicular to the support 34 and out of range of the supporting elements 30. The further means of control 26 keep the holders 16 parallel to the support 34 while they place the attachment slips 18 in position and press them on. As the system continues to rotate, the holders 16 progressively return to their tangential position at supply point 20.

The drive system 88 consists of a drive wheel 108 which has gap-toothed recesses 110 distributed along its circumference. The distance between the recesses 110 is about the same as the distance between the free ends of the supporting elements 30 of the conveyor system 32. With the gluing unit 10 in position against the conveyor system 32, the supporting elements 30 engage in these recesses 110, so that the drive wheel 108 meshes with the supporting elements 30 and is thus driven by and synchronously with the conveyor system 32. This rotary movement of the drive wheel 108 is transmitted via a further chain drive 112 to a drive shaft 114 on which the sprocket wheels 98' and 102' of the chain drives are wedged into place. A further sprocket wheel 86'' is fixed to the drive shaft 114 so that it cannot turn independently of the shaft, but its rotary position relative to the drive shaft 114 is adjustable. The sprocket wheel 86'' is linked by a chain 86' to the bearing box 36. This permits the adjustment of the rotary position of the bearing box 36 in relation to spider 94 of the planetary transmission 90, in order to adjust the sequence of movement of the holders 16.

The bearing plate 82' is on a supporting frame 116 (FIG. 1) and can be pivoted about its axis 116'. A hollow shaft 118 is fixed to bearing plate 82' that provides the seating for a clamping ring 120 to which the bearing plate 82 is fixed. When the clamping ring 120 is released, the relative position of the two bearing plates 82, 82' can be altered, similarly for adjusting the sequence of movement of the holders 16.

The drive shaft 114 passes inside the hollow shaft 118 and can freely rotate within it. Similarly, a lever 122 shaped like a bearing plate is fitted to the drive shaft 114 and can freely rotate on it, and near its free end is located the drive-wheel shaft 108' which can likewise rotate freely around it. The drive wheel 108 is flanged on to the drive-wheel shaft 108' on which the sprocket wheel 112' of chain drive 112 is wedged into place, and the corresponding sprocket wheel 112' is seated on drive shaft 114. The rotary position of sprocket wheel 112' relative to drive shaft 114 is likewise adjustable to alter the phase position of the conveyor system 32 and the gluing unit 10.

An adjustment system (not shown) permits adjustment of the pivot angle of lever 122 relative to the second bearing plate 82', in order to alter the depth that the holders 16 penetrate into the conveyor system 32 when the drive wheel 108 is in its normal working position, as shown in FIG. 1, in which it meshes with the supporting elements 30 of the conveyor system 32. By these means and because the gluing unit's position 10 is adjustable perpendicular to the feed direction A, it is possible to vary the position of the attached slip 18 on the printed product 24, as required.

A conveyor 124 (FIG. 1) feeds the attachment slips 18 one by one to the supply point 20. The conveyor 124 has two conveyor belts 126, 126', each of which forms a closed loop. Between them, they form a feed slit 128 for the attachment slips 18. The conveyor belt 126 passes around a lower roller 130 that rotates about a shaft 116' and an upper roller 130'. The conveyor belt 126' likewise passes around the lower roller 130 and is in close contact with the feed-active section of the conveyor belt to the approximate position of the upper roller 130'. The guide rollers 132 press the feed-active section of the conveyor belt 126' against the feed-active section of the conveyor belt 126 between the lower and upper rollers 130, 130', so that at the supply point 20 the end of the feed slit 128 runs obliquely outward relative to an imaginary straight line connecting the lower and upper rollers 130, 130' on the one hand and the orbital path of the holders 16 on the other. Between them, the flat surface of the holders 16 and the conveyor belt 126 that passes around the upper roller 130' form a tapered transfer slit at the supply point 20 which ensures the safe transfer of the attachment slips 18 to a holder 16 as each slip 18 leaves the feed slit 128. The supporting elements 48 of the holders 16, made as automatically spring-loaded supports, clamp the attachment slips 18 between themselves and the conveyor belt 126 and hold them in place by spring action. At the supply point 20, the feed direction of the conveyor 124 thus forms an acute angle with the orbital track of the holders 16 and the holders 16 themselves. It would also be feasible in this area to align the feed direction of the conveyor 124 approximately parallel to the orbital track.

The upper roller 130', the guide rollers 132, and the other guide rollers 132'' that act on the feed-inactive return section of the conveyor belt 126' are held in bearings in a generally known manner on a bearing plate (not shown) which pivots about an axis 116'. In the area of the supporting frame 116, the conveyor belt 126' passes over guide rollers 134, in order to guide the return section of the conveyor belt at a distance over the lower roller 130 and to form an approximately horizontal transfer area 136 that projects in front of the feed slit 128. In the transfer area 136, the slips for attachment 18 are deposited singly and at the right intervals on the conveyor belt 126', for example by a sheet feeder or feeding attachment.

The conveyor 124 is likewise driven by the drive shaft 114. A sprocket wheel 142, 142' fits on the drive shaft 114 and shaft 140 respectively, which is fixed to the lower roller 130 so that it cannot rotate independently, and a chain 142'' links the sprocket wheels 142, 142'.

The adhesive-applicator apparatus 22 is attached to the bearing plates (not shown) at the upper end of the conveyor 124. An endless adhesive-applicator belt 144 passes over two deflection rollers 146, one of which is driven by a chain drive 148 (indicated by a dot-dashed line) in the direction C (indicated by an arrow). The adhesive-applicator belt 144 has several adhesive-applicator beads 150 spaced behind one another at the same interval as the holders 16 in this area and perpendicular to the sense of rotation C, which apply a strip of adhesive to each attachment slip 18 held by its respective holder 16. The speed of rotation of the adhesive-applicator belt 144 is the same as the speed of the holders 16 in the area in which the holders 16 act in unison with the adhesive-applicator apparatus 22. A scoop roller 152 is mechanically linked to the driven deflection roller 146 by a gear system (not shown). The scoop roller 152 takes up adhesive from an adhesive tub 154 and moistens each adhesive-applicator bead 150 with adhesive. A storage flask 156 filled with adhesive continually tops up the contents of the adhesive tub 154 to replace the used adhesive.

It is, of course, also possible to interrupt the supply of adhesive to the adhesive-applicator belt 144 and its adhesive-applicator beads 150 when required, particularly when there are gaps in the supply of slips 18 for attachment.

A lever drive 158 is provided to pivot the second bearing plate 82' with all components of the gluing apparatus 10 fitted thereto, including the conveyor 124 and the adhesive-applicator apparatus 22, out of the working position, shown by continuous lines in FIG. 1, to a position of rest which places the gluing apparatus 10 outside the operational area of the conveyor system 32. In FIG. 1 dot-dashed lines indicate conveyor 124' and the adhesive-applicator apparatus 22' in the position of rest, i.e. in this position, no slips 18 can be attached.

The gluing apparatus 10 is on a machine frame 160 that is movable across the floor and is adjustable in position in the longitudinal direction of the supporting elements 30. For this purpose the machine frame 160 has two carrying shafts 162 that pass through the base section of the supporting frame 116 for the gluing apparatus 10. The gluing apparatus 10 is movable along the carrying shafts 162. The lever drive 158 is also fitted on the machine frame 116. It would also be feasible to fit the gluing apparatus 10 on a mobile frame of its own and move it into position against the conveyor system 32 when and where required. In that case the second bearing plate 82' would no longer have to be capable of being pivoted.

In the present case, the system described as conveyor system 32 is an apparatus for collecting and/or collating and inserting printed products, as disclosed in the following prior-art documents: EP-A-0 354 343 or the corresponding U.S. Pat. No. 5,094,438, EP-A-0 341 423 or the corresponding U.S. Pat. No. 4,981,291, EPA-0 341 424 or the corresponding U.S. Pat. No. 5,052,666, and EP-A0 341 425 or the corresponding U.S. Pat. No. 5,052,667. See these documents for details of the construction and operation of the devices to which they refer.

The profile-type supporting elements 30 are placed drum-like about a common axis of rotation 164, with their length parallel to this axis. Each supporting element 30 forms a saddle-type support on which printed products 24 can be deposited astride, and each pair of adjacent supporting elements 30 forms a pocket-shaped receptacle into which the printed products 24 can be introduced. For each supporting element 30 there is a mechanically controlled clamping device 166 (FIG. 3) to prevent the printed products 24 falling off as they are moved through the lower part of the drum-type processing apparatus and at the same time to effect a displacement of the printed products 24 toward the axis of rotation 164. FIG. 3 shows that the clamping device 166 acts on the printed products only after the attachment slips 18 have been glued on. Thus, while the slips 18 are being attached, the printed products are not displaced along the supporting elements 30. The drum-type system is held in bearings on the machine frame 160.

Operation

The apparatus shown in the figures works in the following manner:

At a supply point 168, a folded printed product 24 is deposited astride each supporting element 30. As it turns about the axis of rotation 164 in direction A, indicated by an arrow, the printed product 24, which lies in close contact with support 34 while it is in this area of its processing path, comes within working range of the gluing apparatus 10, in which the adhesive-applicator apparatus 22 applies adhesive to an attachment slip 18 which a holder 16 introduced in a pocket-shaped receptacle attaches to and presses upon a portion 24' of a printed product 24. After the printed products 24 to which an attachment slip 18 has been applied have moved past the gluing apparatus 10, the clamping device 166 comes into action and displaces the printed products 24 toward the axis of rotation 164 for further processing. If required, a further printed product may be deposited at a further supply point on these printed products 24 and a further gluing apparatus 10 may be used to glue a further attachment slip thereto.

At the supply points 168, it is also possible, for example, to introduce printed products "fold first" in the receptacle formed by two adjacent supporting elements 30 and then use the gluing apparatus 10 to attach an attachment slip thereto.

The gluing apparatus can also be used with machines that process printed products by means other than a drum-type layout, for example as described in EP-A-0 346 578 or the corresponding U.S. Pat. No. 5,104,108 and in EP-A-0 354 343 or the corresponding U.S. Pat. No. 5,094,438. Common to all these and the other systems previously described above is the fact that their supporting elements with supports for the printed products are oriented across the feed direction A, preferably perpendicular thereto.

The control elements can also be constructed differently; for example, the holders may be fitted to slide in the carrier arms and make a translatory movement, in order to allow the means of control to act upon the control rods 52.

Instead of suction heads 46 fitted to the holders 16, as described above, the carrier arms 14 may have mechanically controlled grippers to pick up and transport the attachment slips 18. In such an embodiment, it may be preferable to provide pressure pads or some other such means over part or the whole of the area where adhesive is applied to the attachment slips 18, in order to press the attachment slips 18 properly upon the printed products 24.

I claim:

1. Apparatus for gluing attachment slips to printed products comprising: rotary means for transporting printed products in a feed direction (A) and having supporting elements extending traverse to the direction (A) and arranged one behind the other at intervals and on which the printed products are supported in close contact; and a gluing apparatus including an adhesive applicator and means for transporting an attachment slip from a supply point past the adhesive applicator and thence to the printed product for pressing the attachment slip onto the printed product on a supporting element of the rotary means, the means for transporting and pressing including a rotating organ, several carrier arms projecting as cantilevers from the rotating organ and arranged one behind the other at intervals in the direction of rotation (B) of the organ, each of the carrier arms having a holder driven to rotate along a fixed path to pick up an attachment slip at the supply point, the rotating organ and carrier arms being designed to introduce the holders between consecutive support elements and control means to move the holders toward a corresponding support element and press the support element with the glued attachment slip on to the printed product supported on a supporting element.

2. Apparatus in accordance with claim 1, wherein the carrier arms are fitted to the rotary organ by joints and can be pivoted forwardly and rearwardly in the direction of rotation (B) by control means.

3. Apparatus in accordance with claim 1, wherein the holders are fitted to the carrier arms by pivots and have further control means to orient the position of the holders to apply and press the attachment slips on to the printed products and hold the holders more or less parallel to supports provided on the supporting elements for the printed products.

4. Apparatus in accordance with claim 2, wherein the rotating organ has a bearing box that rotates about a shaft transverse to the feed direction (A) and on which the carrier arms are pivotally supported about axes parallel to the shaft.

5. Apparatus in accordance with claim 3, wherein the further control means has control rods that engage the holders and are connected to the bearing box.

6. Apparatus in accordance with claim 4 wherein the control means has a planetary transmission with planetary wheels and eccentrically fitted guide elements for the carrier arms.

7. Apparatus in accordance with claim 6, wherein a spider of the planetary transmission that carries the planetary wheels can be driven synchronously with and in the same sense of rotation (B) as the bearing box.

8. Apparatus in accordance with claim 6 wherein the carrier arms slide inside the guide elements.

9. Apparatus in accordance with one of the claims 1, wherein the gluing apparatus has a drive wheel which can rotate freely, if necessary on a frame, and whose circumference has gap-toothed recesses at approximately the same intervals as the supporting elements, whereby, as the supporting elements move past the gluing apparatus, they engage in the recesses to drive the gluing apparatus.

10. Apparatus in accordance with claim 9, wherein the position of the rotating organ and the control means relative to the drive wheel is adjustable, in order to adjust the depth of penetration of the holders between the supporting elements.

11. Apparatus in accordance with claim 16, wherein the holders have elastic suction heads that can be connected via a controlled valve layout to the source of a partial vacuum in order to hold the attachment slips from the supply point until they have been pressed into place.

12. Apparatus in accordance with claim 1, wherein the gluing apparatus has a conveyor to feed the attachment slips to the supply point.

13. Apparatus in accordance with claim 12, wherein the movement of the conveyor at the supply point is approximately tangential or at an acute angle to the fixed path and in the same sense as the sense of rotation (B) of the holders which, as they pick up each attachment slip at the supply point, can pivot into a position approximately parallel with their direction of rotation (B), and the conveyor is so designed as to supply the attachment slips at the same interval as that of the holder.

14. Apparatus constructed in accordance with claim 1 wherein several rotating supporting elements are spaced at intervals one behind another and extend transverse to the sensor of rotation (A).

15. Apparatus constructed in accordance with claim 14, wherein the supporting elements are placed drum-like about a common axis of rotation.

* * * * *

UNITED STATES PATENT AND TRADEMARK OFFICE

CERTIFICATE OF CORRECTION

PATENT NO. : 5,275,685

DATED : Jan. 4, 1994

INVENTOR(S) : Hans-Ulrich Stauber

It is certified that error appears in the above-identified patent and that said Letters Patent is hereby corrected as shown below:

IN THE CLAIMS:

Claim 11: Column 10, line 8

Line 1, delete "16" and substitute --1--.

Signed and Sealed this

Twenty-fourth Day of May, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,275,685

DATED : January 4, 1994

INVENTOR(S) : Hans-Ulrich Stauber

It is certified that error appears in the above-identified patent and that said Letters Patent is hereby corrected as shown below:

Claim 1: Column 8, Line 64

Please delete "support element" second occurrence, and substitute--holder--.

Claim 9: Column 9, Line 29

Please delete "one of the claims" and substitute--claim--.

Signed and Sealed this

Fourteenth Day of February, 1995

*Attest:*

*Attesting Officer*

BRUCE LEHMAN

*Commissioner of Patents and Trademarks*